US005349287A

United States Patent [19]

Lorenz

[11] Patent Number: 5,349,287

[45] Date of Patent: Sep. 20, 1994

[54] LOW POWER COMPARATOR HAVING A NON-SATURATING CURRENT MIRROR LOAD

[75] Inventor: Perry S. Lorenz, Sunnyvale, Calif.

[73] Assignee: National Semiconductor Corporation, Santa Clara, Calif.

[21] Appl. No.: 958,380

[22] Filed: Oct. 8, 1992

[51] Int. Cl.[5] ..... G05F 3/26

[52] U.S. Cl. ..... 323/316; 323/315; 323/317; 330/257; 330/288

[58] Field of Search ..... 323/315, 316, 317; 330/288, 257; G05F 3/26

[56] References Cited

U.S. PATENT DOCUMENTS 3,588,672 6/1971 Wilson ..... 307/297
4,645,999 2/1987 Szepesi ..... 323/315
5,140,187 8/1992 Schwob ..... 307/355
5,220,289 6/1993 Kunitaka ..... 330/257
5,248,932 9/1993 Prentice ..... 323/315

FOREIGN PATENT DOCUMENTS

WO91/13491 9/1991 PCT Int'l Appl. ..... 330/288
853622 8/1981 U.S.S.R. ..... 323/315

*Primary Examiner*—Jeffrey L. Sterrett
*Attorney, Agent, or Firm*—Limbach & Limbach

[57] ABSTRACT

ECL to TTL converter circuits are shown having current mirror loads which produce the required differential to single-ended conversion. Saturation is avoided in the current mirror by connecting a resistor between the collector and base the output transistor.

5 Claims, 2 Drawing Sheets

LOW POWER COMPARATOR HAVING A NON-SATURATING CURRENT MIRROR LOAD

BACKGROUND OF THE INVENTION

Emitter coupled logic (ECL) circuits must often be interfaced with transistor transistor logic (TTL) circuits in integrated circuit (IC) designs. ECL circuits are regarded as the fastest available, but the high speed is obtained with large power dissipation. TTL circuits have been developed to a high degree to operate at high speed and low power. An array of available circuits includes a host of standard functions. Accordingly, where speed is required, an IC chip will include ECL circuits and where speed is not paramount, the logic circuits will involve TTL structures. Accordingly, circuits that convert ECL to TTL are needed. Typically, some form of comparator is employed to perform the transition. Since ECL ordinarily involves complementary or differental signals and TTL involves single ended signals, the comparator typically incorporates a differential to single ended conversion. Accordingly, many of the comparator circuits look very much like operational amplifiers (op-amps). If an op-amp has sufficient signal gain, a substantially rail-to-rail output signal will occur for any input overdrive. Thus, a relatively small ECL input signal swing will produce a TTL compatible output. One of the desired characteristics of such a converter is low operating power. Also desirable is a large signal gain and small signal delay.

DESCRIPTION OF THE PRIOR ART

FIG. 1 is a simplified schematic diagram of the input stages of the well known LM339 which is described as a low-power, low-offset comparator. The circuit operates from a power supply connected + to $V_{CC}$ terminal 10 and − to ground terminal 11. The power supply can be in the range of 2 to 30 volts. Input terminals 15 and 16 accept differential inputs and the single-ended output appears at terminal 17.

PNP transistors 12 and 13 are operated differentially with a constant tail current source 14 providing $I_1$ to the transistor emitters. NPN transistors 18 and 19 are connected as a current mirror load which produces a differential to single ended signal conversion and drives the base of common emitter transistor 20. Current source 21 acts as the load for common emitter amplifier transistor 20.

In these input stages current sources 14 and 21 each typically source about 100 microamperes so the circuit operates at low power. For example, with a 5 volt supply, about 500 microwatts will be dissipated. The LM339 IC has an overall signal gain of about $2\times10^5$. Thus, with a 5 volt supply, a differential input of about 25 microvolts will produce a substantially rail-to-rail output. The LM339 has a typical signal delay of about 300 nanoseconds.

SUMMARY OF THE INVENTION

It is an object of the invention to produce a low power comparator having a reduced signal delay.

It is a further object of the invention to provide a low power comparator having a non-saturating current mirror load which speeds up circuit switching.

These and other objects are achieved by connecting a resistor between the base and collector of the output transistor of the NPN transistor current mirror load. When the input transistor in the current mirror load is receiving input current for the logic signal that produces a current mirror low output, the resistor acts to pull the output transistor collector up and thereby avoid saturation. The resistor value is selected, along with the input stage tail current, to produce the required level of anti-saturation voltage.

DESCRIPTION OF THE INVENTION

Figure 1:
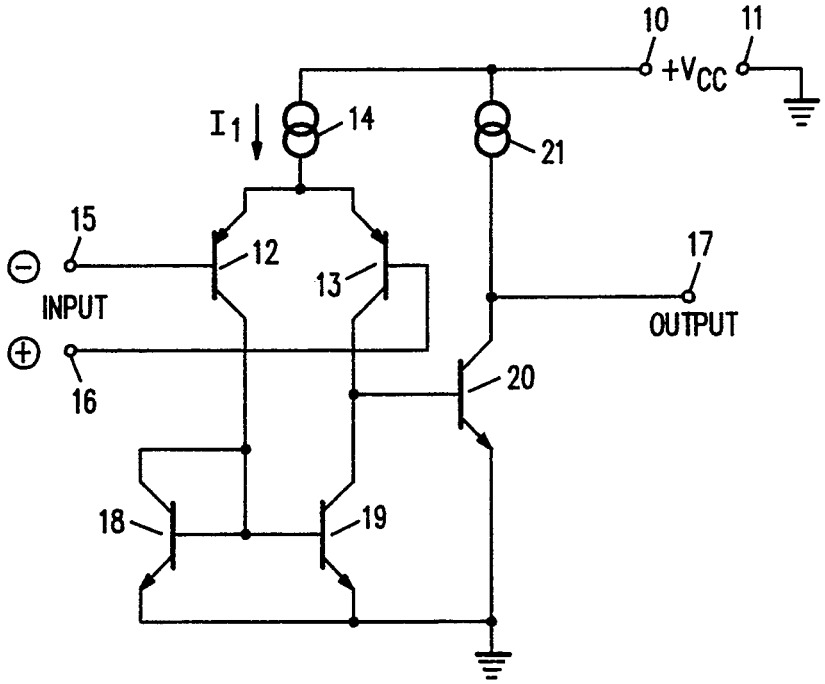
PRIOR ART FIG. 1
FIG. 1 is a simplified schematic diagram of the input stages of the prior art comparator circuit.
Figure 2:
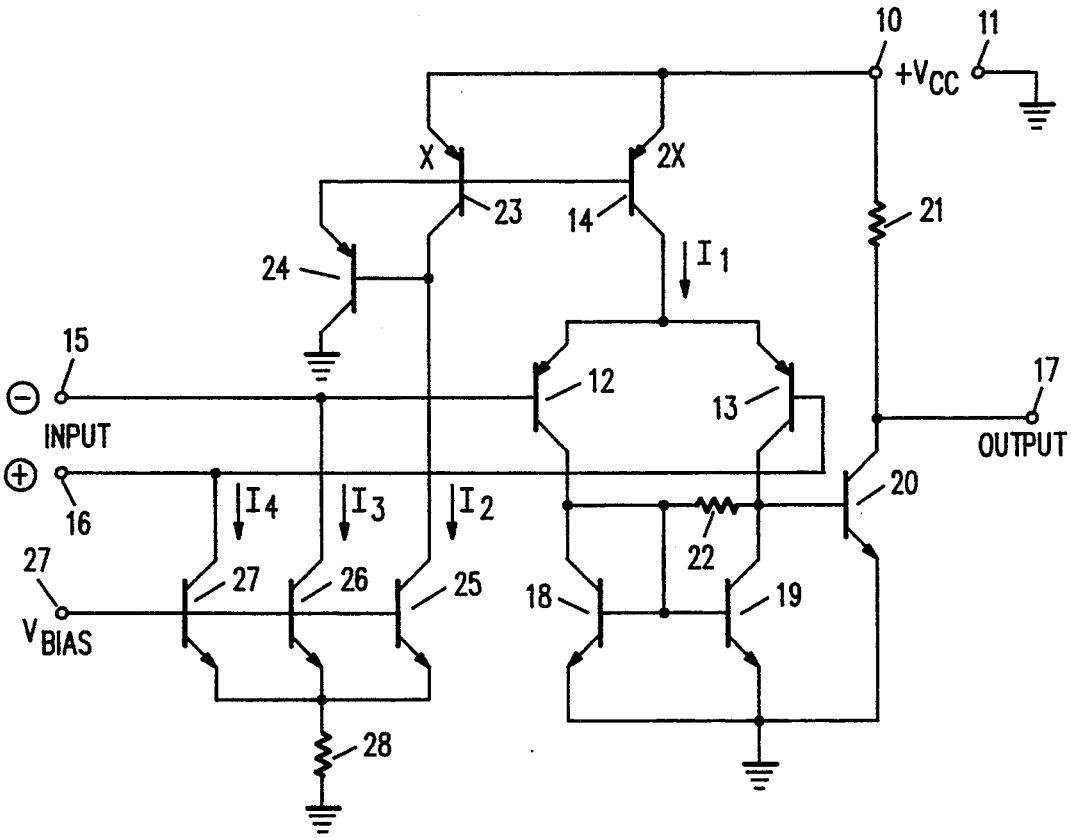
FIG. 2 is a simplified schematic diagram of the preferred circuit of the invention.

FIG. 2 is a simplified schematic diagram of the circuit of the invention. Where the circuit elements are the same as those of FIG. 1, the same designations are used. The circuits shown are all intended for conventional monolithic silicon epitaxial PN junction isolated IC construction.

Input transistors 13 and 12 are PNP lateral devices and the tail current, $I_1$ which flows in transistor 14, is obtained from a super diode current mirror composed of transistors 23 and 24 along with transistor 14. Transistor 24 forces transistor 23 to function as a diode which passes $I_2$. Since transistor 14 is twice as large as transistor 23, the tail current $I_1=2\ I_2$. $I_2$ is a current selected for compatability with ECL driver circuits. Transistors 25–27 along with resistor 28 will produce $I_2-I_4$ as a function of the bias voltage applied to terminal 27. In a typical application $I_2=I_3=I_4=80$ microamperes. In such a case $I_1=160$ microamperes. The ECL driver circuits (not shown) operate at 80 microamperes and have emitter follower outputs which differentially drive terminals 15 and 16. The ECL drive is sufficient to switch transistors 12 and 13.

Figure 3:
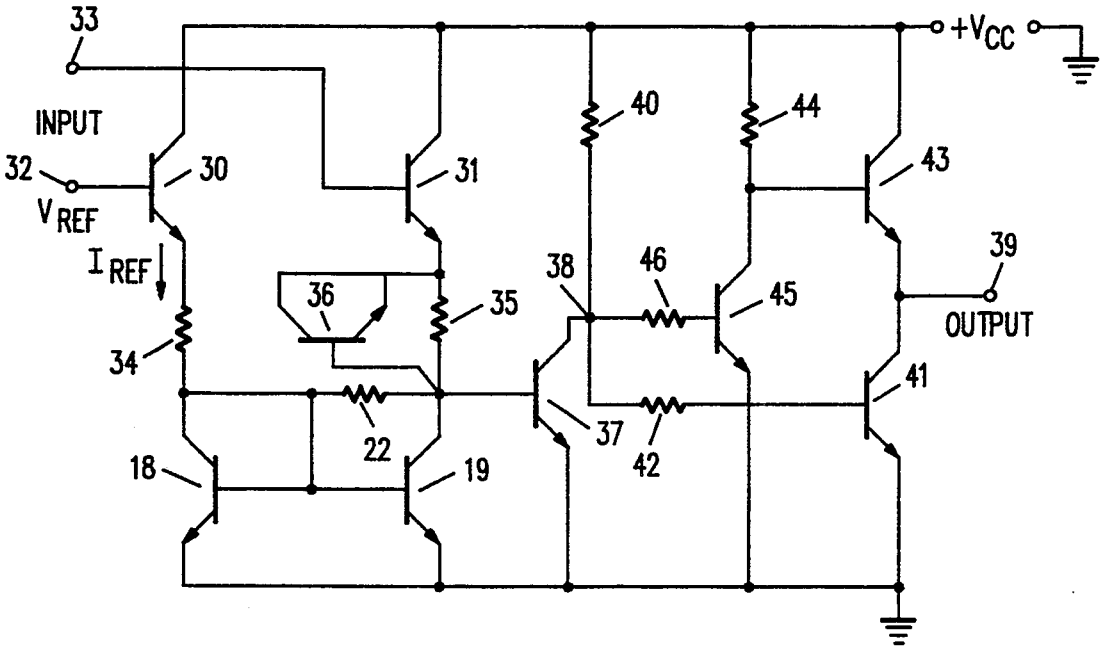
FIG. 3 is a simplified schematic of an alternative circuit of the invention.

When transistor 12 is on (and transistor 13 off) 160 microamperes will flow in transistor 18. Ordinarily (as in the prior art) transistor 19 would saturate. I have discovered that this saturation is the major cause of signal delay in the prior art circuit. Upon discovering this fact, a conceivable circuit modification would be the use of a Schottky transistor for transistor 19. However, this would tend to be self defeating because of the additional node capacitance inherent in Schottky devices. In the circuit of FIG. 2, when the base and collector of transistor 18 are pulled up by the conduction of transistor 12, current will flow in resistor 22 and through transistor 19. This will pull the collector of transistor 19 up. If the pull up action is controlled properly, saturation in transistor 19 can be avoided, but the pull up action is not large enough to turn transistor 20 on. In other words, the voltage drop across resistor 22 opposes the voltage at the collector (and base) of transistor 18. This voltage drop is sufficient to keep transistor 20 off and to hold the collector of transistor 19 out of saturation. For example, if resistor 22 has a value of 5 k ohms and $I_1$ is 160 microamperes, about 80 microamperes will flow in resistor 22. This produces a 400 millivolt potential across resistor 22. If the conducting voltage drop across transistor 18 is 700 millivolts, 300 millivolts is applied to the base of transistor 20 and this is well below the conduction threshold- As a result, transistor 20 will be off and the collector-to-base potential of transistor 19 is about 400 millivolts, which is insufficient to produce saturation, With reference to FIG. 3, a schematic diagram of an alternative embodiment of the invention is shown. An alternative form of ECL to TTL converter is detailed. Current mirror transistors 18 and 19 are present along with antisaturation resistor 22. Transistors 30 and 31 are coupled as emitter followers to be driven from ECL circuitry (not shown). Terminal 32 is connected to the ECL $V_{REF}$ and terminal 33 carries the ECL signal, which swings above and below $V_{REF}$ to set the logic state, Since terminal 32 is at $V_{REF}$, the conduction in transistor 30 is constant, thus, transistor 18 is always on. Resistor 34 has a value that is selected to determine the magnitude of $I_{REF}$. Typically, this will be 180 microamperes. Resistor 35 has a matching value and is shunted by transistor 36 which acts as a capacitor. (For a minimum geometry NPN transistor the capacitance is about 10 pf.) This capacitor shunts resistor 35 and acts as a high frequency signal boost around resistor 35, which would otherwise attenuate high frequency signals. Thus, capacitor 36 acts as a peaking or compensation element. The average current flowing in transistors 31 and 19 will also be 180 microamperes.

When the ECL signal at terminal 33 is high for a logic one, the collector of transistor 19 will be pulled up to a clamp level invoked by the base of transistor 38 which will thereby turn on. This will pull node 38 low or close to ground. Resistor 40 is selected to produce a 100 microampere current in transistor 37. Thus, for a 5-volt supply resistor 40 will be about 50 k ohms. For this condition, transistor 41, which has its base returned to node 38 via resistor 42, will be off. Output terminal 39 will be high due to conduction in transistor 43 which has its base returned to the $+V_{CC}$ rail by way of resistor 44. It will be noted that transistor 45 will also be nonconductive because its base is returned to node 38 via resistor 46. It will be noted that, for the above-described logic one input, both ends of resistor 22 are clamped at one diode above ground and no appreciable current will flow in it.

When the ECL signal at terminal 33 is low for a logic zero, the collector of transistor 19 is lowered. As soon as this collector potential falls, current will flow out of resistor 22 into the collector node, thereby to pull it up. The value of resistor 22 is determined by the value needed to prevent the collector of transistor 19 from going into saturation. Ideally, resistor 22 will hold the collector at about 300 millivolts which is low enough to turn transistor 37 off and yet will be high enough to avoid saturation in transistor 19. For the conditions described above, a value of 24 k ohms is desirable for resistor 22. With the collector of transistor 19 low, transistor 37 will be off and node 38 can rise. This results in both transistors 41 and 45 being turned on. Transistor 45 being on will pull the base of transistor 43 low thereby turning it off. Conduction in transistor 41 will pull output terminal 42 low for a logic zero output. Transistor 45, when conducting, will pull its collector close to ground thus applying substantially $V_{CC}$ across resistor 44. The value of resistor 44 thereby determines the current flowing in transistor 45. For a 5-volt $V_{CC}$ supply, a 24K value for resistor 44 will result in about 200 microamperes flowing therein. Thus, the circuit of FIG. 3 will draw a total current of about 560 microamperes for a logic one and about 460 microamperes for a logic zero. This means that the $V_{CC}$ line will not be subjected to substantial logic-related fluctuations.

Example

The circuit of FIG. 2 was constructed in the form of conventional silicon monolithic P-N junction isolated IC form. The NPN transistors were of vertical construction using minimum geometry and the PNP transistors were of minimum geometry lateral form. Resistor 28 was 2.9 k ohms and resistor 22 was 5 k ohms. $I_1$, the input stage tail current, was 160 microamperes. Pull up resistor 21' was a 2 k-ohm load resistor returned to a 5-volt supply. The circuit displayed a 40 db voltage gain and displayed signal delays: t DHL was 14 ns and t DHL was 29 ns.

The invention has been described and a preferred embodiment detailed. An alternative circuit has also been described. When a person skilled in the art reads the foregoing description, other alternatives and equivalents, within the spirit and intent of the invention, will be apparent. Accordingly, it is intended that the scope of the invention be limited only by the claims that follow.

I claim:

1. An ECL to TTL converter employing a differential driver input responsive to ECL signals, said driver being coupled to current mirror load comprising:

an input transistor having its collector coupled to its base thereby to operate as a diode;

an output transistor having a collector and having its base coupled to said input transistor base;

a resistor connected between said output transistor collector and base whereby saturation is avoided in said output transistor; and output buffer means coupled to said collector of said output transistor whereby TTL output signals are developed.

2. The ECL to TTL converter of claim 1 wherein said differential driver comprises:

a pair of emitter follower transistors having their inputs driven differentially by said ECL signals; and means for coupling the outputs of said pair of emitter follower transistors to said current mirror.

3. The ECL to TTL converter of claim 2 wherein said pair of emitter follower transistors and said current mirror comprise NPN transistors.

4. The ECL to TTL converter of claim 1 wherein said differential driver comprises:

first and second input transistors having their emitters coupled together and to a constant current element thereby producing differential operation; and means for applying said ECL signals to the bases of said first and second transistors.

5. The ECL to TTL converter of claim 4 wherein said first and second transistors are PNP transistors having their emitters connected to a constant current source and said current mirror transistors are NPN transistors.

* * * * *